United States Patent [19]

Sinclair et al.

[11] 4,135,962

[45] Jan. 23, 1979

[54] APPARATUS FOR DECORATING SHEET MATERIAL

[75] Inventors: Robert I. Sinclair, Mendham; Frederick D. Godfrey, Jr., Maplewood, both of N.J.; John J. Fedro, Wilkes-Barre, Pa.

[73] Assignee: Consolidated Cigar Corp., New York, N.Y.

[21] Appl. No.: 727,052

[22] Filed: Sep. 27, 1976

[51] Int. Cl.[2] ..... B44B 5/00

[52] U.S. Cl. ..... 156/387; 156/209; 156/277; 156/390; 156/555; 101/23; 101/32; 118/44; 118/224

[58] Field of Search ..... 156/277, 209, 553, 276, 156/219, 210, 390, 555, 387; 131/15 R, 15 A, 15 B, 15 C, 20 A; 428/141, 151, 152; 427/264, 275; 101/32, 17, 23; 118/44, 224

[56] References Cited

U.S. PATENT DOCUMENTS

| | | | |
|---|---|---|---|
| 134,196 | 12/1872 | Crump | 101/17 |
| 2,316,785 | 4/1943 | Gladeck | 131/24 |
| 2,887,414 | 5/1959 | Rosenberg et al. | 131/15 C |
| 3,024,154 | 3/1962 | Singleton et al. | 156/277 |
| 3,328,221 | 6/1967 | Pufahl | 156/209 |
| 3,560,322 | 2/1971 | Magid | 156/209 |
| 3,936,339 | 2/1976 | Lock et al. | 156/210 |

*Primary Examiner*—John T. Goolkasian
*Assistant Examiner*—William H. Thrower
*Attorney, Agent, or Firm*—Gregory J. Battersby; Charles I. Sherman; Thomas E. Harrison

[57] ABSTRACT

Methods and apparatus are taught for decorating sheet material such as, for example, cigar wrappers. The apparatus includes feeder means for drawing the sheet material toward and around a center cylinder; decorating means for imparting a predetermined pattern on the sheet material; coloring means for coloring the sheet material and drawing and rewind means for drawing the sheet material from the center sheet guide means.

An alternate embodiment teaches methods and apparatus for use with at least two layers of sheet material such as, for example, cigar wrapper sheet material, one of such layers being decorated and colored and then laminated to the other layer.

25 Claims, 23 Drawing Figures

FIG. 4
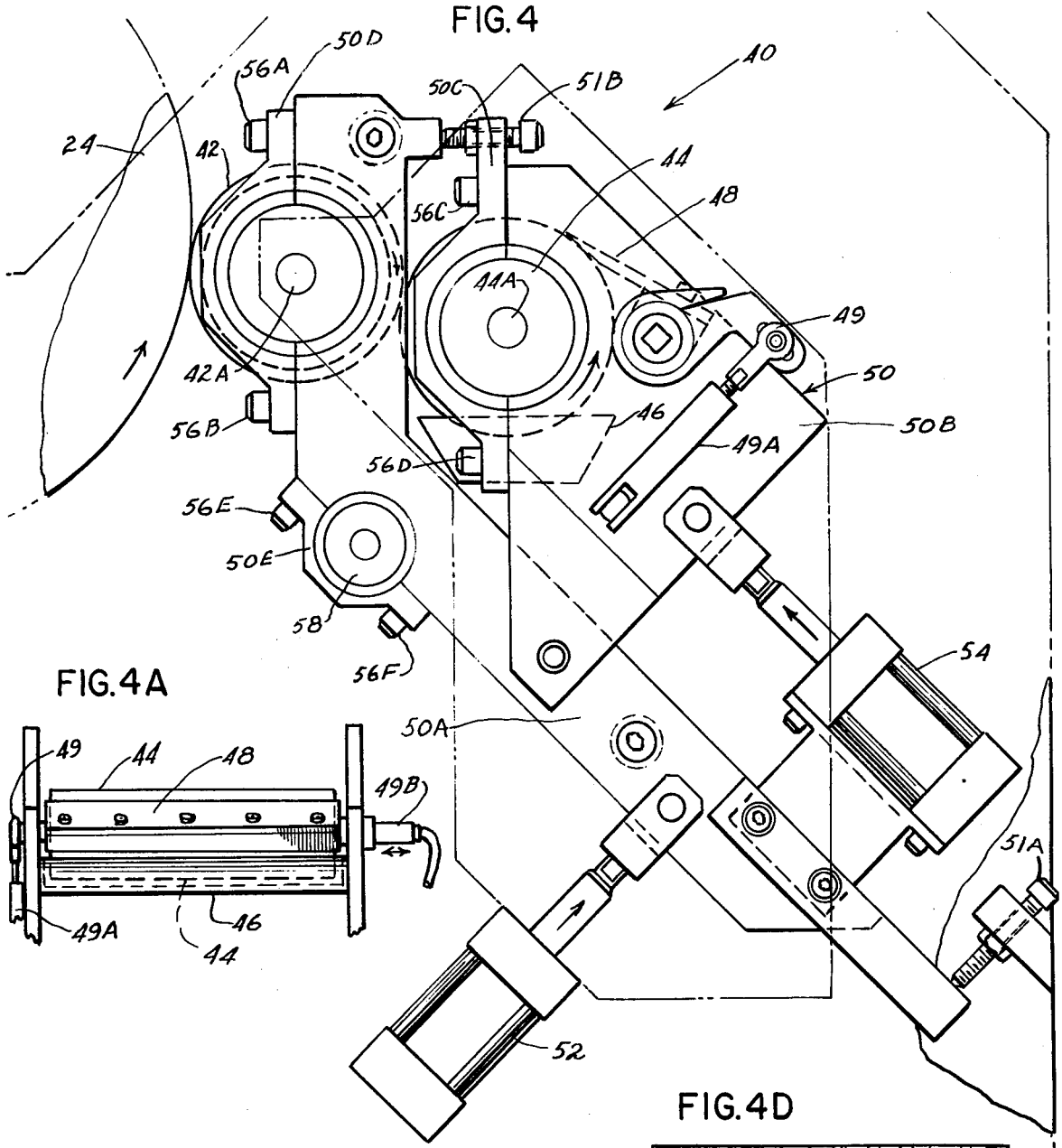
FIG. 4A
FIG. 4B
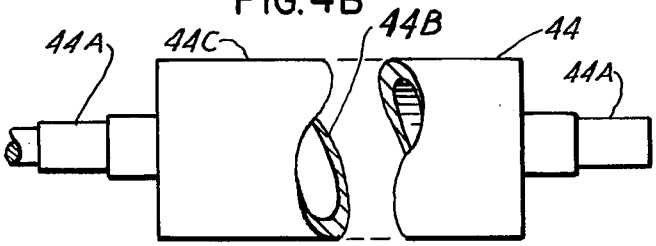
FIG. 4C
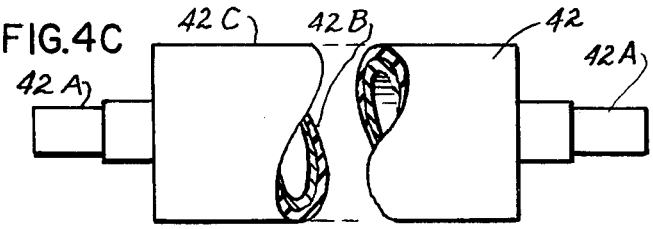
FIG. 4D
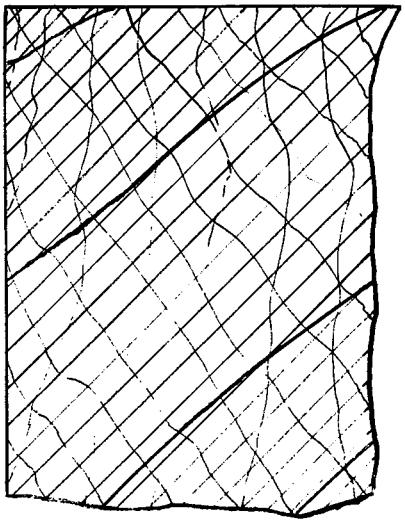

60
71A
71B
71C
71E
71G
71H
74
76A
76E
76F
76G
76H
75A
75B
64
64A
66
68
69
69A
70
72
24
26
62
80
82
90A
90B

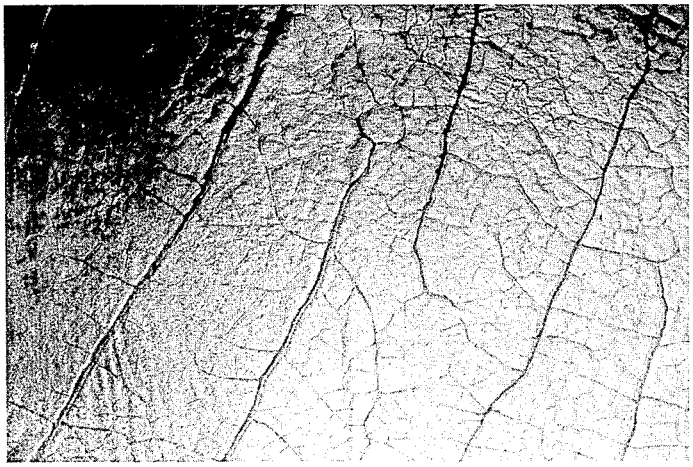
FIG.8
FIG.9
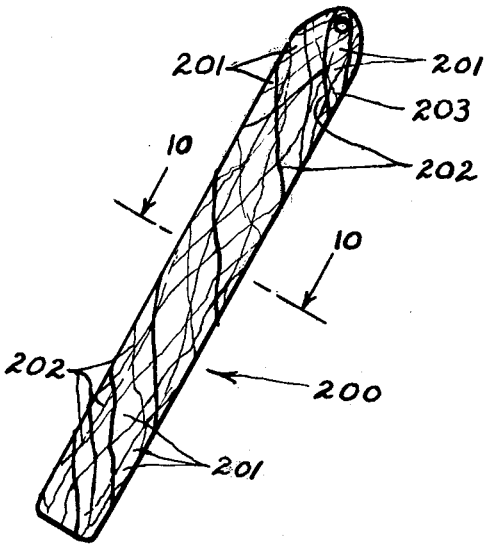
FIG.10
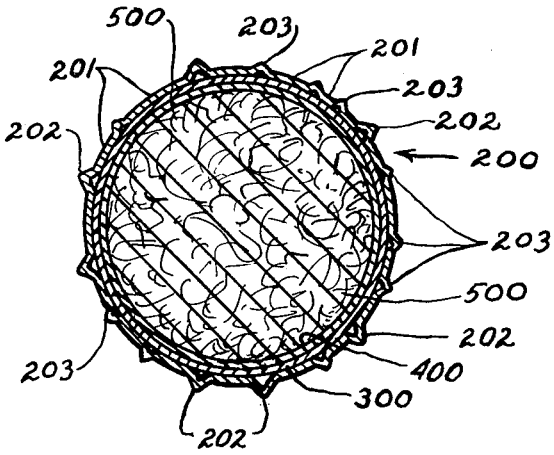

APPARATUS FOR DECORATING SHEET MATERIAL

RELATED APPLICATION

Cross-reference is made to concurrently filed U.S. Pat. application Ser. No. 727,054 filed Sept. 27, 1976 now U.S. Pat. No. 4,109,665 in the names of FREDERICK D. GODFREY, JR., JOHN J. FEDRO and ROBERT I. SINCLAIR entitled DECORATED CIGAR WRAPPERS.

BACKGROUND OF THE INVENTION

This invention relates generally to methods and apparatus for decorating sheet material such as, for example, a manufactured cigar wrapper, and, more particularly, to a method and apparatus for embossing a predetermined pattern such as, for example, a vein pattern, on such sheet material.

The present invention is particularly useful in embossing a vein pattern, similar to the vein pattern of a naturally appearing tobacco leaf, on a manufactured cigar wrapper. Cigars generally are wrapped with either a natural tobacco leaf or a manufactured wrapper which includes a mixture of natural tobacco, adhesives and cellulosic fibers.

The advantage of using a manufactured cigar wrapper rather than a natural tobacco leaf resides in its considerably lower cost and the increased ability to manipulate both taste and aroma by the addition of appropriate additives. The natural tobacco leaf has, historically, been the symbol of a quality cigar and, accordingly, it has been a goal of cigar manufacturers to simulate the appearance of a natural tobacco leaf wrappers on manufactured wrappers.

To this end, cigar wrapper manufacturers have, on numerous occasions, attempted to print or draw a natural vein pattern on a sheet of manufactured cigar wrapper. For example, British Pat. No. 14,494, which issued to William Watson on Nov. 3, 1884, teaches the embossing, stamping or printing of natural tobacco leaf designs on manufactured tobacco paper. Similarly, U.S. Pat. No. 2,316,785, which issued to Frederick C. Gladeck on Apr. 20, 1943, discloses the embossing of a sheet of manufactured tobacco wrapper with a pattern which simulates leaf tobacco. See also, in this regard, U.S. Pat. No. 3,145,717 which issued to F. H. Osborne, et al. on Aug. 25, 1964 and which discloses the calendering or embossing of a sheet of manufactured cigar wrapper with a leaf design having stems and veins.

A particular problem experienced by cigar wrapper manufacturers in embossing or engraving such a veined pattern on the manufactured cigar wrapper is that during subsequent manufacturing operations and during use, as the sheet is stretched, the raised vein pattern is stretched flat and is thus removed. This is particularly true when the humidity of the wrapper rises. Prior art attempts at embossing or printing vein patterns on manufactured cigar wrappers have not, heretofore, been successful because the generally uniform color of the manufactured wrappers did not appear natural when compared to the randomly colored natural tobacco leaf.

Against the foregoing background, it is a primary objective of the present invention to provide methods of and apparatus for decorating sheet material such as, for example, manufactured cigar wrappers.

It is another object of the present invention to provide methods of and apparatus for embossing a predetermined pattern on sheet material such as, for example, a manufactured cigar wrapper, which will not be removed during subsequent processing operations and during use.

It is still another object of the present invention to provide a method of and apparatus for imparting a base color and a shade color pattern on the embossed sheet material such as, for example, a manufactured cigar wrapper.

It is a further object of the present invention to provide a method of and apparatus for imparting a base color and shade pattern on the embossed sheet material such as, for example, a manufactured cigar wrapper, and then laminating thereto, in a symbiotic relationship, a second sheet having similar or dissimilar properties to that of the embossed and colored sheet.

It is yet still a further object of the present invention to provide an efficient, economical and commercially accepted method of and apparatus for decorating cigar wrapper material.

SUMMARY OF THE INVENTION

To the accomplishments of the foregoing objects and advantages, the present invention, in brief summary, comprises: apparatus and methods for coloring and decorating sheet material such as, for example, manufactured cigar wrappers. The apparatus includes a rotatably mounted center cylinder about which is positioned an embossing roller for embossing a pattern on said sheet material at elevated temperature and pressure; coloring means for coloring said sheet material a predetermined color; shading means for randomly shading said sheet material with a predetermined shade pattern; and reinforcing means for applying a filler material on one side of the embossed sheet material to fill and thus reinforce the recessed portions of the embossed pattern. Staining, coating and humidifying means may also be provided.

An alternate preferred embodiment uses similar apparatus to decorate, color, shade and reinforce one sheet and then provides laminating means to laminate this sheet to a second sheet. Similarly, staining, coating and humidifying means may also be provided.

BRIEF DESCRIPTION OF THE DRAWINGS

The foregoing and still other objects and advantages of the present invention will be made apparent from the following detailed explanation of the preferred embodiments of the invention in connection with the accompanying drawings wherein:

FIG. 4 is an enlarged, general side elevational view of the base color station of the apparatus of FIGS. 1 and 2;

FIG. 4A is an enlarged, general front elevational view of the base color station of the apparatus of FIGS. 1 and 2;

FIG. 4B is a front elevational view of the color gravure roller of the base color station;

FIG. 4C is a front elevational view of the color transfer roller of the base color station;

FIG. 4D is illustrative of the sheet material after the vein pattern and base color have been applied;

FIG. 8 is a photograph of a sheet of cigar wrapper material decorated using the apparatus of FIGS. 1 and 2;

FIG. 9 illustrates a cigar having a decorated laminated wrapper produced using the apparatus of FIG. 2;

FIG. 10 is an enlarged cross-sectional view of the cigar of FIG. 9 taken along line 10—10 with exaggerated wrapper thickness.

DESCRIPTION OF THE PREFERRED EMBODIMENTS

Figures 1, 2:
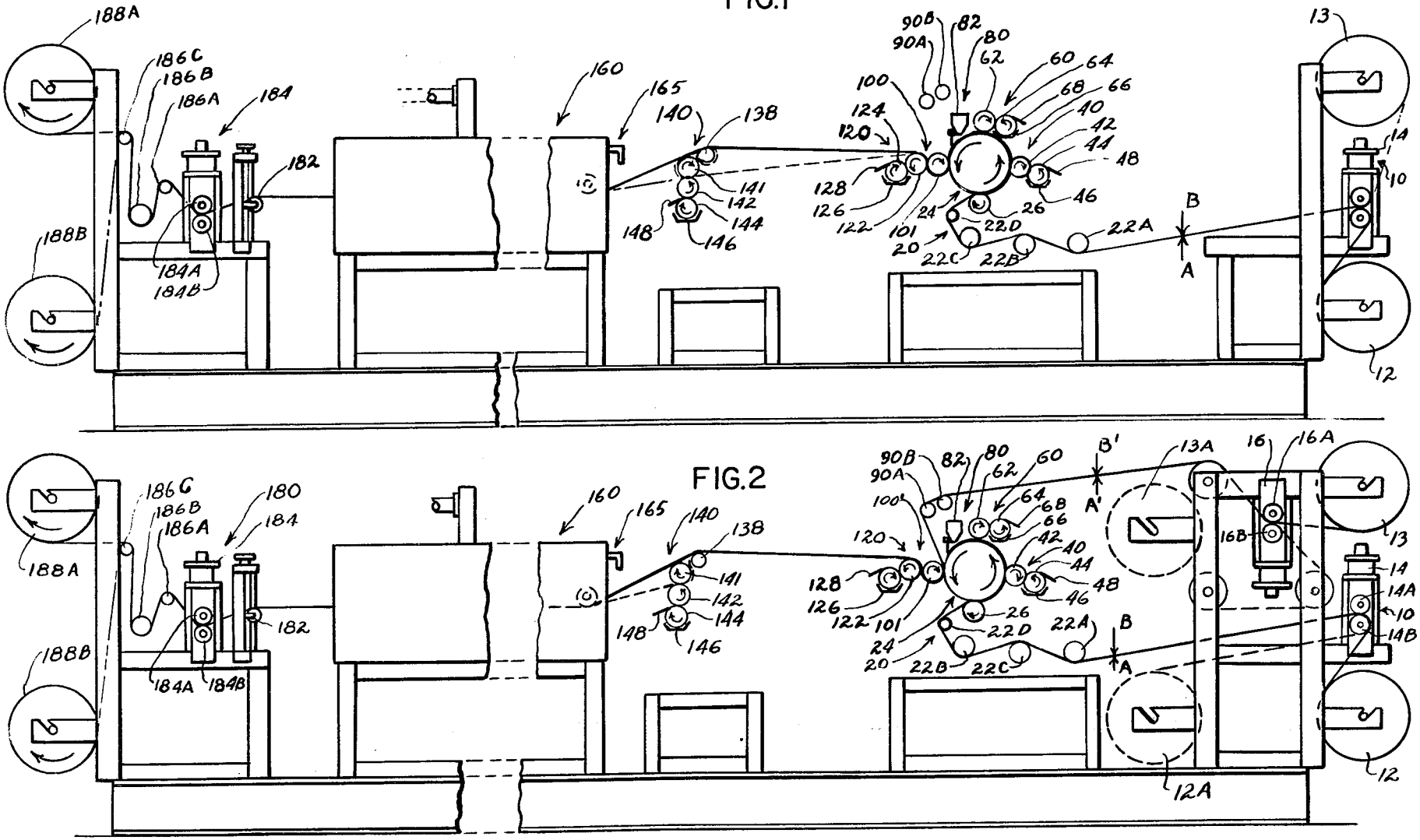
FIG. 1 illustrates in schematic form the decorating apparatus of the present invention.
FIG. 2 illustrates in schematic form an alternate embodiment of the decorating apparatus of FIG. 1 wherein two sheets are laminated together after decoration.

Referring now to FIG. 1, there is shown schematically the apparatus and method of the present invention as it is used to decorate and color manufactured sheet material. In this embodiment, only one layer of sheet material, having a predetermined thickness with opposed surfaces A and B, is preferably coated on at least one side A with a hydrophobic coating prior to processing through the apparatus of the present invention. This sheet material, which may, for example, be a sheet of manufactured cigar wrapper including a mixture of ground tobacco and refined pulp and which measures about 0.003 inches in thickness, is processed according to the following methods and using the following apparatus.

As shown in FIG. 1, identical sheet material is stored on either a lower roll 12 or an upper roll 13 in the unwind station 10 with the coated side A facing outwardly. The free end of the undecorated sheet material is first fed through a splicing unit 14 and toward the center cylinder 24 in such a manner that the uncoated side B is upwardly facing. Splicing unit 14 permits continuous running of the apparatus since, as the sheet material on the lower roll 12 is depleted, similar sheet material from the upper roll 13 may then be spliced by splicing unit 14 into the material from the lower roll 12. Embossing, coloring and shading stations, 20, 40 and 60 respectively, are positioned about the center cylinder 24. The sheet material passes through and about idler takeup rollers 22A, 22B, 22C and 22D and around center cylinder 24, first passing through the nip between the center cylinder 24 and the embossing roller 26 where a predetermined pattern is embossed through the thickness of the sheet, forming a raised pattern on the coated side A of the sheet. The embossed sheet then continues around the center cylinder 24, where the uncoated side B of the sheet is treated with colorants to simulate a natural tobacco leaf at a base color station 40 and at a shade pattern station 60.

The sheet material, after having passed through the shade pattern station 60, has a raised, embossed pattern on the coated surface A thereof, with the uncoated surface B being colored and shaded. The decorated sheet material is then removed from the center embossing cylinder 24 at a removal station 100. The decorated sheet material may, if desired, be coated at a coating station 120 and stained at a staining station 140. When the sheet material is a manufactured cigar wrapper, it is desirable to pass the decorated wrapper through a humidifier 160 which increases the moisture level of the sheet and thus prevents it from tearing or cracking. The decorated sheet material is then rewound at a rewind station 180.

FIG. 2 illustrates schematically the method and apparatus used in decorating one sheet of manufactured sheet material and then laminating the decorated sheet to a second, undecorated sheet. It will be appreciated that this method utilizes essentially the same apparatus as discussed in FIG. 1 with certain minor differences. In the apparatus of the embodiment of FIG. 2, the sheet material to be decorated is stored on lower rolls 12 and 12A and the sheet material to be laminated to the decorated sheet is stored on the upper rolls 13 and 13A at the unwind station 10 with both sheets being processed simultaneously. The sheet from the lower rolls 12 and 12A is processed in an identical manner as the sheet of FIG. 1, and, after this decoration, coloring and shading, it is then laminated to the second undecorated sheet from upper rolls 13 and 13A at laminating station 100' of FIG. 2. Two lower rolls 12 and 12A and two upper rolls 13 and 13A are provided to permit splicing at splicing units 14 and 16 as a roll is depleted, thus assuring continuous operation of the apparatus.

The detailed description of the various portions of the apparatus which follows will apply to the apparatus used for the manufacture of both laminated and nonlaminated sheet material, as shown schematically in FIGS. 1 and 2, any differences being specifically noted.

The sheet material to be decorated which, in the embodiment of FIG. 1 is stored on both the upper and lower rolls 13 and 12, respectively, and, in the embodiment of FIG. 2 is stored on lower rolls 12 and 12A is first fed from the unwind station 10 toward the embossing 20, coloring 40 and shading stations 60, which are positioned about the center cylinder 24. In the embodiment of FIG. 2, where two sheets are laminated together, sheet material from upper rolls 13 or 13A is fed simultaneously over the top of the center cylinder 24 and is laminated in juxtaposition to the decorated sheet at laminating station 100'.

When forming decorated and laminated sheets with the apparatus of FIG. 2, each sheet should have a thickness of preferably about 0.0015 inches and each is preferably coated on at least one side A or A' with a hydrophobic coating material such as, for example, a derivitized cellulosic material. The hydrophobic coating applied to the coated side A' of the sheet material from the upper rolls 13 and 13A preferably includes a glyceride in an amount sufficient to lower the melting point of the coating to below about 400° F. The sheet material from the lower rolls 12 and 12A is also preferably coated on side A with a hydrophobic coating, similar to the hydrophobic coating applied to sheet material from the upper rolls 13 and 13A, but not including glyceride.

In the embodiment of FIG. 1, where sheet material from upper and lower rolls 13 and 12, respectively are used, the sheet material preferably is about 0.003 inches thick and is coated on side A with a hydrophobic coating.

When the sheet material to be decorated is, for example, a manufactured cigar wrapper, it preferably includes ground tobacco, refined pulp, filler materials, adhesives, has a preferable sheet weight of from about $1.0g/ft^2$ to about $6.0g/ft^2$ and has a moisture level of at least about 19%.

As shown in FIGS. 1 and 2, the coated sheet material to be decorated is directed through the two rollers 14A and 14B which comprise splicing unit 14 of unwind station 10 and toward the embossing 20, coloring 40, shading 60 and reinforcing 80 stations positioned about center cylinder 24. Splicing unit 14 permits splicing of the sheet material to be decorated from one roll to another as the one roll is depleted to insure a continuous feed of material. A second splicing unit 16 is provided for use in the embodiment of FIG. 2 and comprises rollers 16A and 16B which permit splicing of the sheet material from one of the upper rolls to the outer roll 13A. Take-up rollers 22A, 22B, 22C and 22D serve to insure that the sheet material remains taut throughout processing. The take-up roller 22D, positioned directly beneath the embossing station 20 may be a bowed roller such as, for example, a Mount Hope roller, since such a roller maintains the sheet material flat and taut during processing.

The coated sheet material to be decorated is first introduced into embossing station 20 where it passes through the nip between the center cylinder 24 and the embossing roller 26. Embossing roller 26 is shown in greater detail in FIGS. 3, 3A, 3B and 3C, FIGS. 3 and 3C illustrating the cooperation between the center cylinder 24 and the embossing roller 26.

Figure 3:
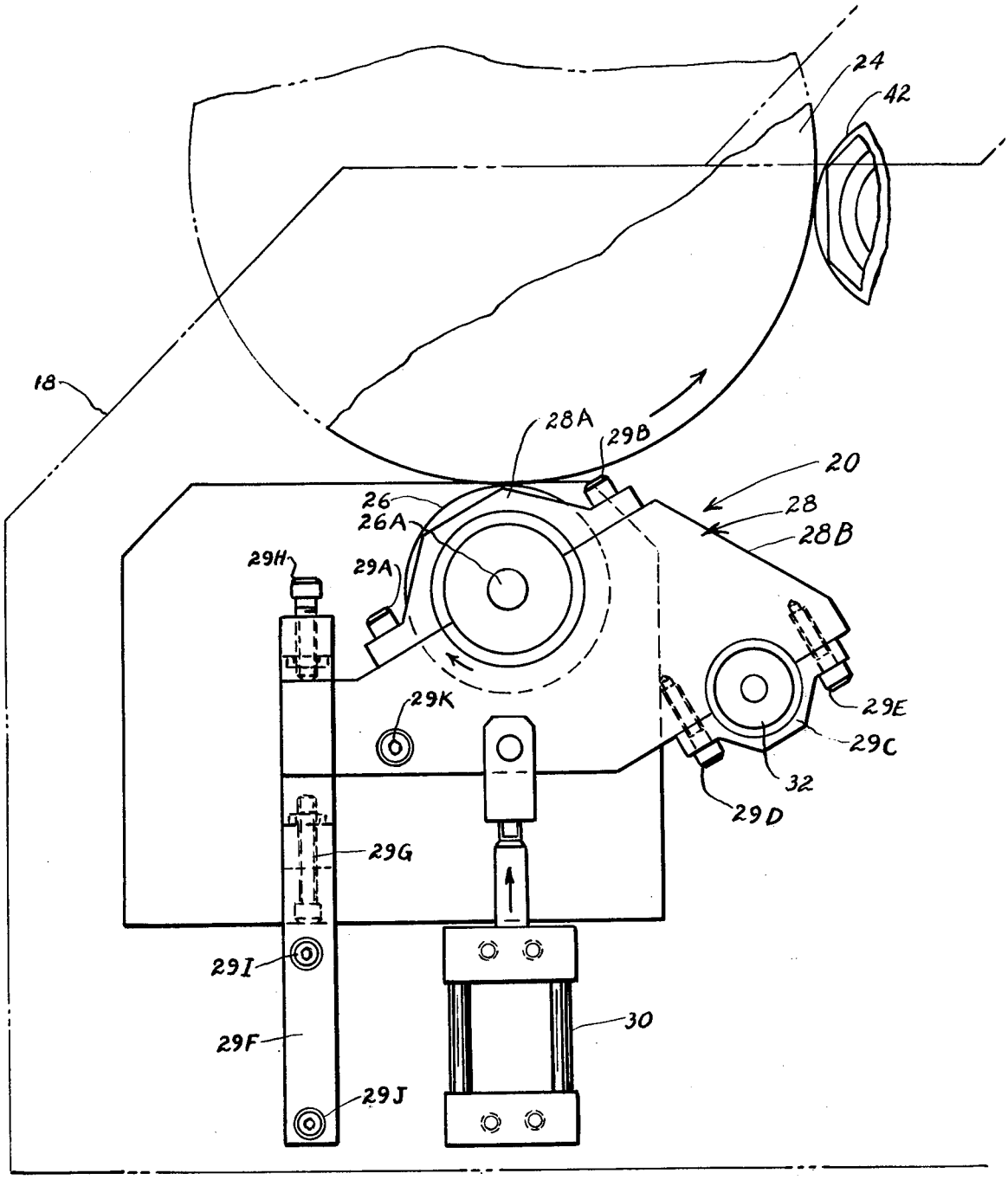
FIG. 3 is an enlarged, side elevational view of the embossing station of the apparatus of FIGS. 1 and 2.
Figure 3A:
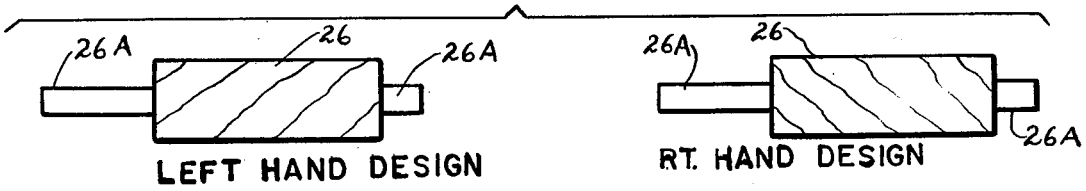
FIG. 3A illustrates in schematic form the alternative forms which the embossing roller forming part of the embossing station of FIG. 3 may assume.
Figure 3B:
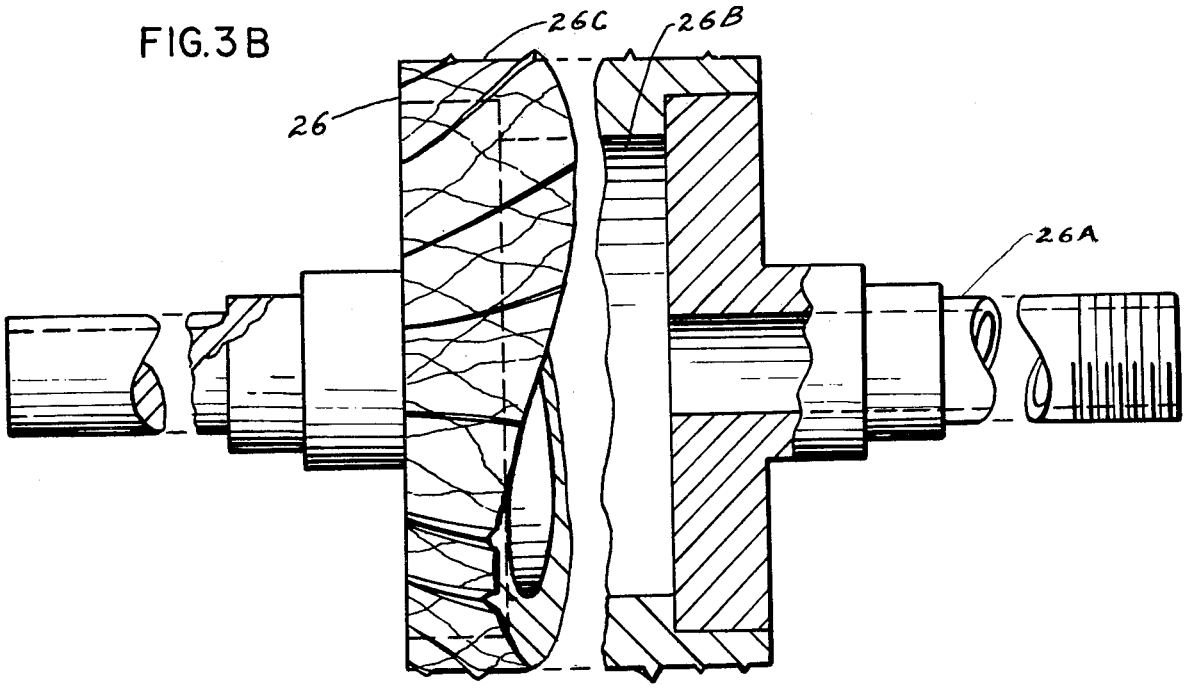
FIG. 3B is an enlarged, breakway sectional view of the embossing roller.
Figure 3C:
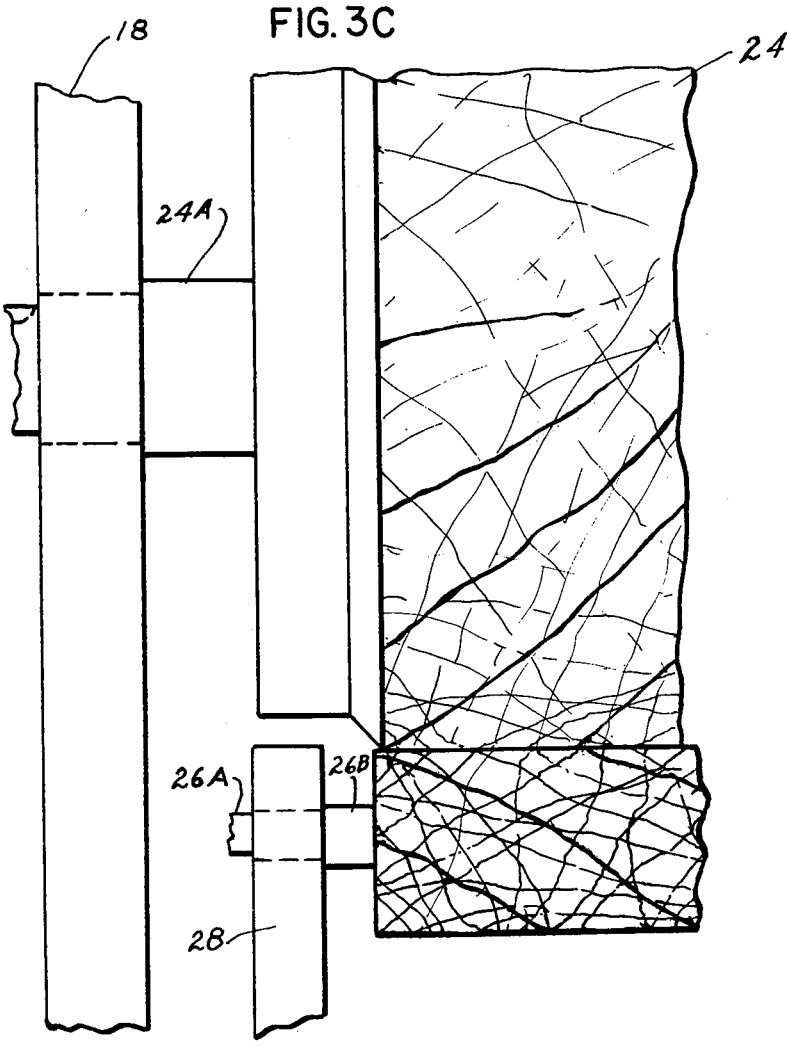
FIG. 3C is a partial front elevational view illustrating the cooperating relationship between the embossing roller and the center cylinder.

As shown in FIGS. 3B and 3C, center cylinder 24, which is preferably steel with either a chrome-plated or paper filled outer surface portion, is rotatably mounted on a frame 18 by means of hub portions 24A which extend from opposite ends of the center embossing cylinder 24 and are rotatably journaled in apertures on opposite sides to the frame 18. The center cylinder 24 has a female recessed decorative pattern, preferably a veined pattern, on the outer surface thereof. When the outer surface of the cylinder 24 is paper filled, a synchronized female or recessed decorative pattern may be formed on this surface by mounting the embossing roller 26, which includes a male or raised pattern on its outer surface, adjacent the cylinder 24 and then rotating the cylinder 24 and the embossing roller 26 in opposite directions to cut a pattern synchronized to the pattern of the embossing roller 26 into its paper filled outer surface. When the outer surface of the center cylinder 24 is chromeplated steel, the center cylinder 24 and the embossing roller 26 should be a matched set.

Figure 3D:
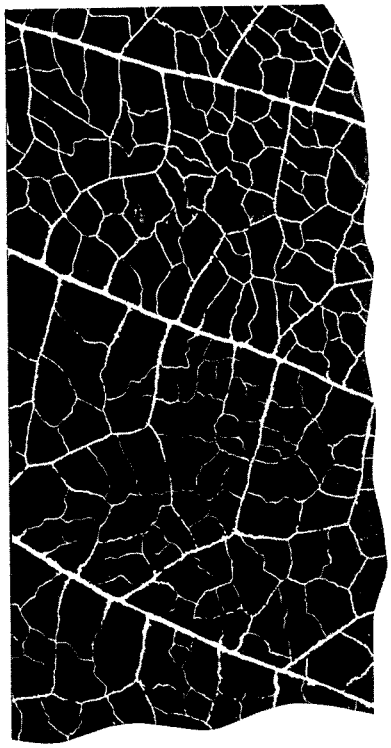
FIG. 3D is a positive print illustrating the vein pattern which is embossed on the sheet material.

The embossing roller 26, shown in FIGS. 3, 3A, 3B and 3C, is rotatably mounted on the frame 18 adjacent to the center embossing cylinder 24 so as to permit the sheet material to pass through the nip between the embossing roller 26 and the center cylinder 24 when the cylinder 24 and the embossing roller 26 rotate in opposite directions. The embossing roller 26, which preferably is steel with a chrome-plated outer surface 26C, includes a male decorative pattern on the outer surface 26C. Such pattern may be etched or engraved and is complimentary to the recessed female pattern on the outer surface of the center cylinder 24. This decorative pattern is preferably a vein pattern, such as, for example, the pattern shown in FIG. 3D. As such, when a sheet of wrapper material is passed through the nip between the embossing roller 26 and the center cylinder 24, under elevated heat and pressure, the pattern on the cylinder 24 and roller 26 is embossed into and through the sheet material. An engraved pattern is preferred on the outer surface 26C of the embossing roller 26 since it produces a more pronounced raised pattern on the wrapper than an etched pattern would. Both left hand and right hand leaf patterns may be used on the outer surface of the embossing roller 26, as shown in FIG. 3A.

Referring back to FIG. 3, embossing roller 26 is also rotatably and adjustably mounted on the frame 18 by means of stepped, hub portion 26A which extend from opposite ends of the embossing roller 26 and are rotatably journaled on adjustable mounting supports 28 which are affixed to the frame 18 at opposite sides thereof. Supports 28, which permit adjustment of the embossing roller 26 relative to the center cylinder 24, include upper and lower plates 28A and 28B, respectively, which rotatably capture the hub portion 26A of the embossing cylinder 26 and which are secured by retaining or anchor bolts 29A and 29B. Mounting shaft 32, which interconnects both sides of frame 18, is also secured to support 28 by means of support plates 28B and 29C which are secured using anchor bolts 29D and 29E. The pressure exerted by the embossing roller 26 against the center cylinder 24 which determines vein depth, is provided by at least one conventional, adjustable air cylinder 30 which effects movement of lower plate 28B toward the center cylinder 24 along a post 29F thus forcing embossing roller 26 against center cylinder 24. The pressure between the embossing roller 26 and the center cylinder 24 may be controlled by the use of adjusting screws 29G and 29H which control the travel of lower plate 28B toward center cylinder 24.

Adjusting screws 29G and 29H are set initially to insure proper registration between the male pattern on the embossing roller 26 and the female pattern on the center cylinder 24. The post 29F along which support plate 28B travels, is secured to the frame 18 by the use of two bolts 29I and 29J.

The embossing roller 26, shown in greater detail in FIG. 3B, has a substantially hollow center portion 26B, access to which is available through the hollow, stepped, hub portions 26A. The embossing roller 26 may be heated by the introduction of steam through the hub portions 26A and into the hollow center portion 26B of the embossing roller 26. Condensed water may be removed through, for example, a conventional rotary joint on one side of the embossing roller 26 (not shown).

Embossing of the sheet material may be accomplished at temperatures above about 250° F. and preferably at temperatures between about 250° F. and about 350° F. An embossing temperature of about 280° F. is most preferred. An embossing pressure of at least about 50 psi between the embossing roller 26 and the center cylinder 24 generated by air cylinder 30, is normally required to effect satisfactory embossing of the sheet material and a pressure of about 90 psi is preferred.

Referring back to FIGS. 1 and 2, the embossed sheet material then passes around the center cylinder 24 toward the base color station 40 where the sheet material is treated with a base colorant to simulate the color of a natural tobacco leaf. In those instances where the sheet material is pre-colored prior to processing, the base color station may be eliminated and the sheet may be merely embossed or embossed and shaded. The base color station 40, shown in greater detail in FIGS. 4, 4A, 4B and 4C includes a color transfer roller 42, of steel with a rubber or elastomeric outer surface and a color gravure roller 44 also of steel with a chrome-plated outer surface.

The color gravure roller 44, shown schematically in FIG. 4B, preferably includes a hollow center portion 44B with stepped hub portions 44A extending from the opposite ends thereof. The chrome-plated outer surface of the color gravure roller 44 is patterned, preferably having a 180Q quadra gravure recessed pyramid shaped pattern formed thereon. The color gravure roller 44 on the frame 18 is adjustably and rotatably mounted by means of an adjustable support 50 mounted on both sides of the frame 18. Hub portions 44A of roller 44 are journaled in recessed portions of adjustable mounting device 50. It is preferred that the color gravure roller 44 be cooled and this may be accomplished by passing cool water through the hollow center portion 44B of the roller 44.

The color transfer roller 42, shown schematically in FIG. 4C, includes a rubber or elastomeric outer surface 42C, a hollow center portion 42B and stepped hub portions 42A which extend from opposite ends of the color transfer roller 42. The elastomeric outer surface 42C of the transfer roller preferably has a hardness of between about 40 and about 70 Durometer Shore A. It is preferred that the transfer roller 42 be cooled to retard drying of the coloring agent which it transfers to the sheet material and cooling may be accomplished, for example, by the pumping of cool water into the hollow center portion 42B through one of the stepped hub portions 42A.

Since in actual operation, the coloring agent is applied to recessed portions of the color gravure roller 44 and then transferred to the color transfer roller 42 as the two rollers contact and rotate in opposite direction, it will be appreciated that the alignment of and the pressure between the rollers is important. The color transfer roller 42 transfers the coloring agent in the pattern of the color gravure roller 44 to the sheet material as the sheet material passes through the nip between the counter rotating center cylinder 24 and the color transfer roller 42. Coloring agents may include inks and dyes and preferred coloring agents include carotenoids and annattos; food, drug and cosmetic dyes including their lake and oil solubilized forms; and other commercial food grade inks.

As shown in FIG. 4A, the coloring agent is applied directly to the color gravure roller 44 by the use of an open ink pan 46 positioned adjacent to the color gravure roller 44, and spaced such that, as the color gravure roller 44 rotates, the outer surface of the gravure roller 44 passes through the coloring agent contained within the ink pan 46, thereby "inking" the roller. A doctor blade 48, mounted tangentially relative to the color gravure roller 44 is used to remove any heavy deposits of the coating agent on the rotating color gravure roller 44. The coloring agent is introduced into the open ink pan 46 by conventional means, i.e. by its introduction under pressure from an external supply. The coloring agent should be fed into the ink pan 46 at a sufficient rate to maintain a substantially filled level and an overflow return system (not shown) may be provided to assure continuous circulation of the coloring agent.

The doctor blade 48, which may be steel or a plastic material, includes a bracket 49 which is preferably adjustably mounted on frame 18 in order to control its position relative to the color gravure roller 44. The doctor blade 48 may be spring or air loaded, such as by air cylinder 49A to generate pressure against the color gravure roller 44. It is preferable that the doctor blade 48 be reciprocating relative to the longitudinal extent of the color gravure roller 44 to aid removing heavy deposits of coloring agents which may accumulate on the surface of the color gravure roll 44. Reciprocation is effected by means of air cylinder 49B, shown in FIG. 4A.

As shown in detail in FIG. 4, the color gravure roller 44, the color transfer roller 42, the ink pan 46 and the doctor blade 48 are adjustably mounted on and secured to the frame 18 by use of an adjustable support 50 which includes a plurality of interengaged and adjustable plates 50A, 50B, 50C, 50D and 50E and two screw threaded adjusting devices 51A and 51B which permit adjustment of the position of the plates which control the pressure between the color gravure roller 44 and the color transfer roller 42 and between the color transfer roller 42 and the center cylinder 24.

A conventional adjustable air cylinder 52 is employed to generate pressure between the transfer roller 42 and the center cylinder 24 and a second conventional air cylinder 54 is used to generate pressure between the transfer roller 42 and the gravure roller 44. Adjusting screw 51A acts as a stop for air cylinder 52 permitting adjustment of the pressure between the transfer roller 42 and the center cylinder 24. Similarly, adjusting screw 51B acts as a stop for air cylinder 54 and permits adjustment of the spacing between the transfer roller 42 and the gravure roller 44. Anchor bolts 56A and 56B secure plate 50D to plate 50A in order to rotatably capture the transfer roller 42 therebetween and anchor bolts 56C and 56D serve to secure plate 50C to plate 50B to rotatably capture the gravure roller 44 therebetween. Support shaft 58 is rotatably captured between plates 50E and 50A which are secured thereto by anchor bolts 56E and 56F.

Figures 5, 5A, 5B:
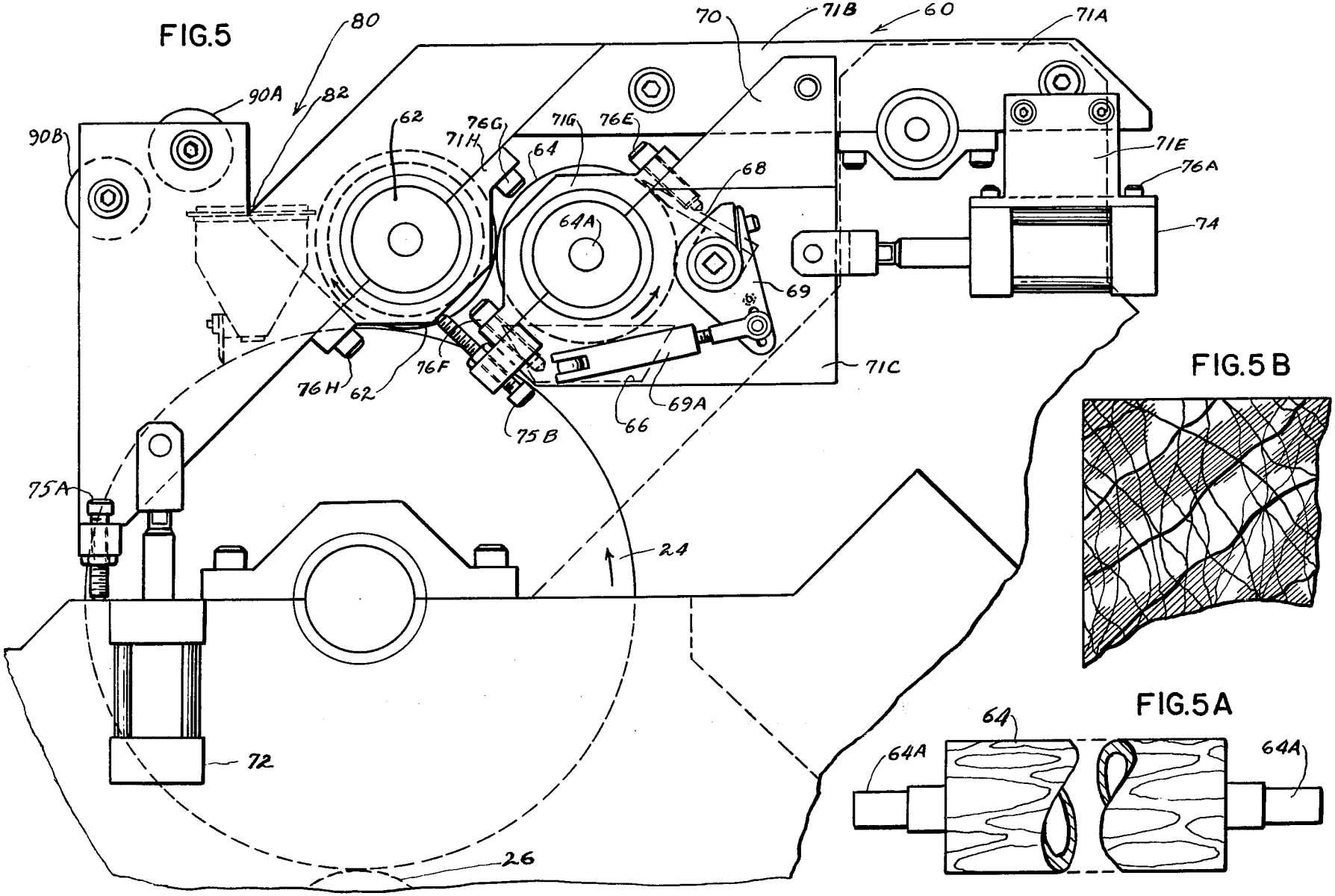
FIG. 5 is an enlarged, general side elevational view of the shading station of the apparatus of FIGS. 1 and 2.
FIG. 5A is a front elevational view of the shade gravure roller of the shading station.
FIG. 5B is illustrative of the sheet material after the vein pattern, the base color and the shade pattern have been applied.

The embossed sheet material, after passing through the base color station 40 where a base coloring agent is applied in the pattern of the color gravure roller 44 then proceeds through a shade pattern station 60 as shown in FIGS. 5 and 5A where a random or otherwise irregular color pattern is applied.

As previously stated, when the sheet material is pre-colored prior to processing, the sheet may pass directly from the embossing station 20 to the shade pattern station 60, thus bypassing the base color station 40. When the sheet material is, for example, a cigar wrapper, a random "cloud-pattern" may be applied using contrasting colors to further simulate the irregular or random color patterns of a naturally occuring tobacco leaf. The shade pattern station 60, shown in detail as FIGS. 5 and 5A, includes a shade transfer roller 62 of similar construction to color transfer roller 42 and a shade gravure roller 64, also of similar construction to the color gravure roller 44, but for the pattern on the outer surface thereof.

The shade gravure roller 64, shown schematically in FIG. 5A, which is preferably made from steel, is hollow and includes on its outer, preferably chrome-plated steel surface, a randomly diffused, 120Q screen pattern. An open ink pan 66 and a doctor blade 68, similar to the open ink pan 46 and the doctor blade 48 of the base color station 40, are provided with a similar supply and circulation system. An adjustable support 70 is provided for mounting the elements of the shade color station 60 to the frame 18, the adjustable support 70 being similar to the adjustable support 50 used in the base color station 40. In this regard, adjustable support 70 includes a plurality of plates 71A–H and two adjustable air cylinders 72 and 74 positioned on adjacent sides of the support 70 to provide pressure, respectively, between the shade transfer roller 62 and the center cylinder 24 and between the shade transfer roller 62 and the gravure roller 64. Adjusting screws 75A and 75B are provided to respectively control the amount of pressure between the rubber transfer roller 62 and the center cylinder 24 and between the shade gravure roller 64 and the shade transfer roller 62. A plurality of anchor bolts 76A–H serve to secure the plates 71A–H together.

As in the base color station 40, an adjustable bracket 69 is provided, including a pressure piston 69A to adjustably mount the doctor blade 68 relative to the gravure roller 64 and an air cylinder 69B to permit reciprocation of the doctor blade 68 across the longitudinal extent of the outer surface of the shade gravure roller 64.

A shading agent is applied to the embossed and colored sheet material by the shade transfer roller 62 which, by contacting and rotating in an opposite direction from the shade gravure roller 64 receives the shading agent in the shade pattern of the shade gravure roller 64, then transfers it to the sheet material as it passes through the nip between the center cylinder 24 and the transfer roller 62. The shade transfer roller 62, which is of a similar construction to the color transfer roller 42, may be cooled in a similar manner as the color transfer roller is cooled, i.e. by introducing cool water into its center.

The shading agent used may be an ink or a dye, preferably of contrasting color to the coloring agent. Preferred shading agents include carotenoids and annattos; food, drug and cosmetic dyes including their lake and oil solubilized forms; and other commercial food grade inks. The decorated, colored and shaded sheet material, as it emerges from the shade station 60, is shown in FIG. 5B.

Figure 6:
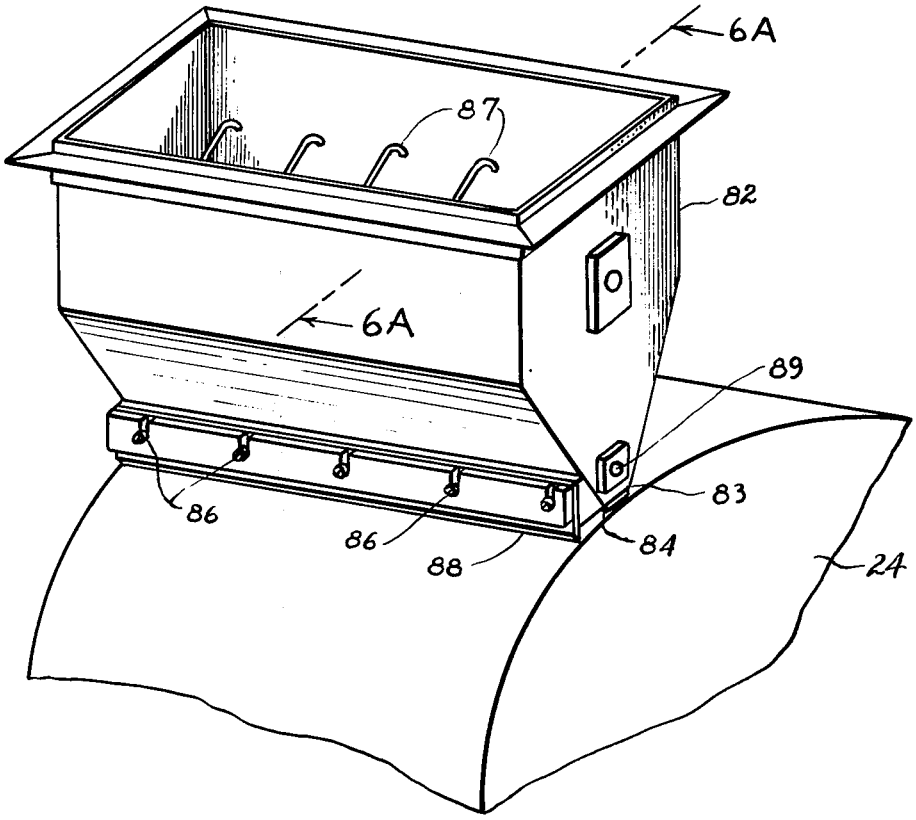
FIG. 6 is an enlarged perspective view of the reinforcing station of FIGS. 1 and 2.
Figure 6A:
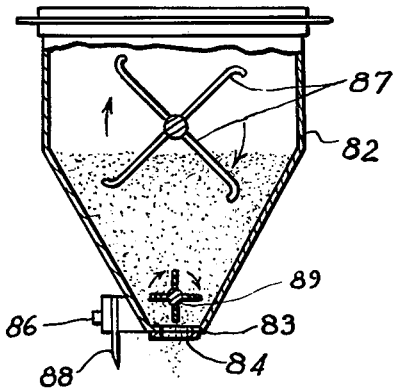
FIG. 6A is a side view of the reinforcing station of FIG. 6.
Figure 6B:
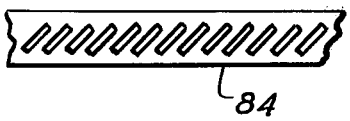
FIG. 6B is a partial bottom view of the distribution plate used in the reinforcing station of FIG. 6.

The now embossed, colored and shaded sheet material then proceeds around the center embossing cylinder 24 to a reinforcing station 80 where a filler material is introduced onto the top uncoated surface B of the sheet material as shown in FIGS. 6 and 6A. Reinforcing station 80 includes a hopper 82 which is mounted on frame 18 (not shown) adjacent to the center cylinder 24 in which may be added filler material for distribution onto the sheet material as it passes around the cylinder 24. The hopper 82 includes a wire screen 83 above a slotted distribution plate 84 through which the filler material is introduced onto the uncoated surface B of the sheet material. A rubber blade-like device 88 is adjustably mounted to the bottom edge of the hopper 82 by a plurality of screws 86 and, when properly adjusted and upon rotation of the cylinder 24, serves to force the filler material into the recessed portions of the embossed pattern on uncoated surface B of the sheet and to remove any excess filler material from the nonrecessed portions of the sheet material. Blade 88 may be replaced by a roller or other similar device (not shown). A rotatably mounted doffer 87 is provided to prevent agglomeration of the filler material in the hopper 82 and a rotary blade feeder 89 is provided to aid in forcing the filler material through slotted distribution plate 84 and onto the sheet material. The rate of distribution of the feeder material is controlled by the rate of rotation of the blade feeder 89.

Filler materials may be either in powder or paste form, the powder including a mixture of ground tobacco suitable binding agents and fillers including diatomaceous earths, clays and whitening agents. Preferred diatomaceous earths include the product marketed by Grefco, Inc. of Los Angeles under the trademark Dicalite® and the product marketed by JohnsManville of Denver under the mark Celite®. Preferred clays include Bentonite®, marketed by NL Industries of New York, Kaolin and monmorillonite and preferred whitening agents, which serve to give the filled vein pattern a more naturally colored look, may be selected from the group consisting of titanium dioxide, calcium carbonate and dolomite.

In certain instances, it may be desirable to use a paste type filler material rather than a powder, particularly in the embodiment where only one, non-laminated layer is used. In order to form such a paste, the powder described above may be mixed with suitable vehicles, and wetting agents.

In the embodiment of FIG. 2, where two sheets are laminated together, the sheet material from the lower rolls 12 and 12A, which has then been embossed, colored, shaded and reinforced, is then mated with and laminated in juxtaposition to the undecorated sheet material from the upper rolls 13 and 13A of the unwind station 10 which is passed over the center cylinder 24 by take-up rollers 90A and 90B. The two layers are mated in such a manner that the coated side A' of the undercoated sheet material is in juxtaposition with the uncoated side B of the embossed sheet material and are then fed into and through a laminating station 100' where they are laminated or otherwise bonded together to form a unitary embossed and laminated sheet.

Figure 7:
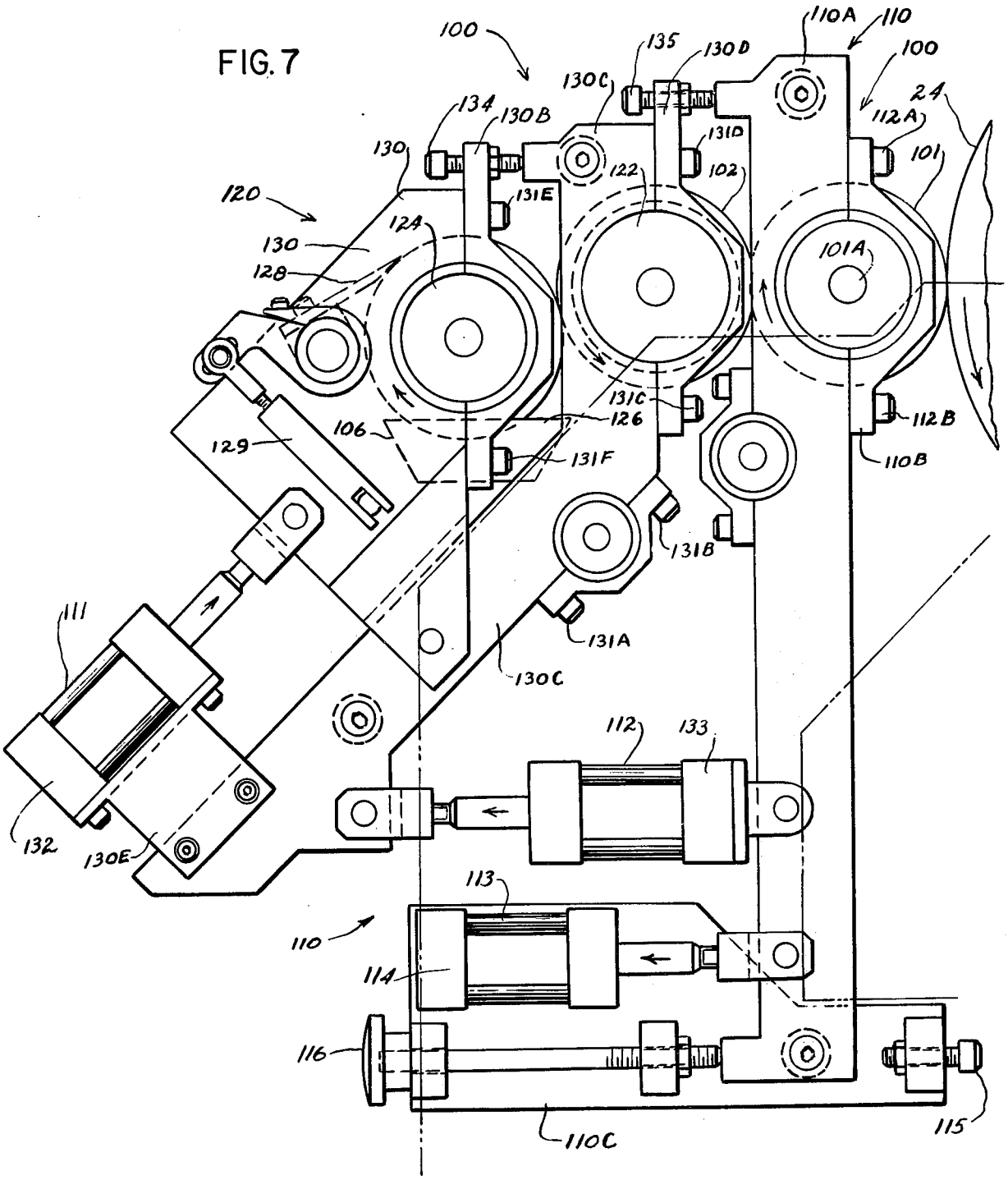
FIG. 7 is an enlarged, general side elevational view of the laminating station of FIGS. 1 and 2.
Figure 7A:
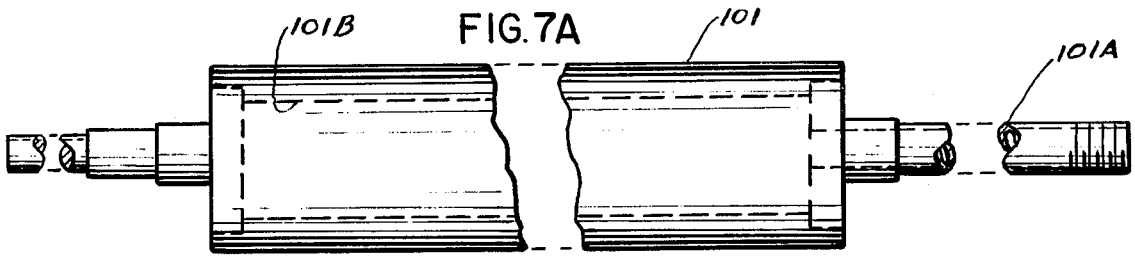
FIG. 7A is a front elevational view of the laminating roller.

The laminating station 100', as shown in FIGS. 7 and 7A, includes a laminating roller 101, preferably of chromeplated steel and having a hollow center portion 101B and two hub portions 101A extending from opposite ends thereof. As shown in FIG. 7, the laminating roller 101 is journaled on an adjustable support 110 which includes plates 110A, 110B and 110C. Anchor belts 112A and 112B rotatably capture and mount the hub portions 101A of the laminating roller 101 between plates 110A and 110B. Air cylinder 114 serves to generate a constant pressure between the laminating roller 101 and the center embossing cylinder 24, the amount of pressure being controlled by adjusting screw 115 and adjusting wheel 116.

The two sheets are laminated together as they pass through the nip between the laminating roller 101 and the center embossing cylinder 24 at elevated temperature and pressure. Lamination should be accomplished at a temperature sufficient to soften the hydrophobic coating on the coated surface A' of the top, undecorated sheet and thus laminate the undecorated sheet to the embossed and colored sheet. Since it is not desirable to have the coating on the embossed sheet soften, lamination is preferably effected at a temperature of between about 250° F. and about 350° F., with a temperature of about 280° F. being most preferred. This temperature may be achieved by the introduction of steam into the hollow center portion 101B of the laminating roller 101 through the hollow tubular end portion 101A. The pressure exerted between the laminating roller 101 and the center cylinder 24 by air cylinder 114 should be between about 50 psi and about 150 psi, and preferably between about 75 psi and about 100 psi. A laminating pressure of about 90 is most preferred.

In the embodiment of FIG. 1 where the decorated sheet is not laminated to a second sheet, the laminating roller 101 is maintained at room temperature and merely serves as a removal roll for removing the embossed, colored, shaded and reinforced sheet from the center cylinder 24.

If desired, a secondary coating may be applied to the sheet material of either FIG. 1 or FIG. 2, preferably at coating station 120 which is located adjacent laminating roller 101. Coating station 120 includes a coating transfer roller 122 and a coating gravure roller 124, shown in greater detail in FIG. 7. Coating station 120 is similar to both the base color station 40 and the shade color station 60 in that the coating is applied to the sheet material by the transfer roller 122 as it passes through the nip between the transfer roller 122 and the laminating roller 101. The coating transfer roller 122 and the coating gravure roller 124, which are similar in design to the color transfer roller 42 and the color gravure roller 44 are rotatably mounted on an adjustable support 130 which includes inter-engaged plates 130A–130E which are secured to one another by a plurality of anchor bolts 131A–131F. Air cylinders 132 and 133 provide pressure respectively between the coating transfer roller 122 and the color gravure roller 124 and between the transfer roller 122 and the laminating roller 101. Pressure generated by air cylinder 132 between the gravure roller 124 and the coating transfer roller 122 is adjusted by adjusting screw 134 and the pressure generated between the transfer roller 122 and the laminating roller 101 is controlled by adjusting screw 135. The coating applied at the coating station 120 may be, for example, a hydrophobic coating and is applied to the sheet material in a similar manner as the base color and shading were applied. The secondary coating is applied to the coating gravure roller 124 as it rotates through an open pan 126. A reciprocating doctor blade 128, adjustably mounted on support 130 and powered by air cylinder 129, is also provided. The coating is transferred to the sheet material from the coating gravure roller 124 by the oppositely rotating coating transfer roller 122 as the sheet material passes through the nip between the oppositely rotating laminating roller 101 and transfer roll 122.

An additional staining step at staining station 140 may also be incorporated into the processes of FIGS. 1 and 2, staining being done after the decorated sheet passes from the coating station 120 over a take-up roller 138. Staining station 140 is of similar design to base color station 40 and shading station 60 and is shown schematically in FIGS. 1 and 2. Staining is used to further delineate the pattern being embossed on the sheet material. Suitable staining agents include both saturated and unsaturated, synthetic or natural vegetable oils, such as, for example, glycerides.

Staining station 140 includes an upper, internally heated, roller 141 preferably of chrome-plated steel, which is in direct contact with an oppositely rotating transfer roller 142 which is of similar construction to color transfer roller 42. Stain is applied to the transfer roller 142 by an oppositely rotating stain gravure roller 144 which includes an open pan 146 for applying stain to the gravure roller 144 and a doctor blade 148 for removing excess heavy deposits of stain from the gravure roller 144. Stain is introduced into pan 126 by circulation means similar to the system used for introducing and circulating the coloring and shading agents. As the decorated sheet material travels between the upper, heated roller 141 and the stain transfer roller 142, the stain is applied to the raised, decorated side of the decorated sheet material by the stain transfer roller 144. The upper heated roller 141, like the laminating roller 101, has a hollow center portion through which steam is passed to elevate the temperature of the upper roller 141 to thus accomplish staining at elevated temperatures. Preferably, the upper heated roller 141 is maintained at a temperature of at least about 90° F. with a temperature within the range of from about 100° F. to about 120° F. being most preferred.

The staining station 140, which includes rollers 141, 142 and 144, stain containing pan 146 and doctor blade 146, is rotatably and adjustably mounted on a frame (not shown) of similar design to frame 18 which supports the embossing, coloring, shading and laminating stations.

The decorated sheet material may after passing through the staining station 140, be introduced into a humidifier 160 of conventional design where the moisture level of the sheet material is raised to a pre-determined level. This is particularly recommended when the sheet material is a cigar wrapper where after processing, the wrapper should have a moisture level of at least about 25% and preferably between about 28% and about 35%. A moisture level of about 30% for the final product is most preferred. Humidification is preferably accomplished by the simultaneous introduction of steam through a plurality of jets onto both surfaces of the sheet material as it passes through the humidifier 160.

It has been found that humidification is most effective when the temperature of the sheet material is maintained at a temperature of about 110° F. and this may be accomplished by maintaining a constant circulation of air around the sheet material. The application of a very fine spray of cool water applied to the sheet material through water jets 165 positioned immediately adjacent to the humidifier 160 results in greater moisture levels in the final, humidified product. The water on the wrapper functions as a heat sink and prevents drying of the sheet material during humidification 160.

After humidification, the sheet material is drawn into a rewind station 180, as shown in FIGS. 1 and 2, first passing over an idler roller 182 and then through a drive assembly 184 which includes upper and lower puller rollers 184A and 184B, respectively, which serve to pull the sheet material through the apparatus. It is then fed over take-up rollers 186A, 186B and 186C and rewound around either top or bottom rewind rollers 188A and 188B. Take-up roller 186B is a moisture detection roller and monitors the moisture of the sheet material prior to re-rolling on rollers 188A and 188B, thus permitting increased or decreased humidification by humidifier 160, if necessary.

The apparatus of FIGS. 1 and 2 may be powered by conventional means (not shown) and preferably by coordinated D.C. motors. It is preferred that three separate D.C. motors be used, with one master motor to rotatably drive the center cylinder 24 with the rollers comprising the embossing coloring, shading, reinforcing and laminating stations 100', being geared to the center cylinder 24 by conventional gearing. Secondary motors are provided at the rewind station 180 and at the staining station 140 and are subordinate to the master motor driving the center cylinder 24, with their drive speed being dependent upon the speed at which the master motor operates.

It will be appreciated that the tension of the sheet material must be maintained at a relatively constant level during processing to prevent tearing or pulling of the sheet material and irregular lamination. This may be accomplished by the use of conventional take-up rollers or dancer rollers positioned at various points throughout the apparatus. For example, dancer rollers may be positioned between the laminating station 100' and the staining station 140 and between the staining station 140 and the humidifier 160. A potentiometer may be employed on one or more of the dancer rollers to both change the speed of the drive assembly 184 automatically and to control the speed of rewind rollers 188A and 188B in order to maintain proper tension of the sheet material.

As previously stated, when the sheet material is, for example, a cigar wrapper, the moisture level of the sheet material must be maintained above a minimum moisture level to prevent the sheet material from tearing or cracking. It is therefore preferred that the sheet material have, prior to processing, a moisture level of at least about 19% with a moisture level of at least about 22% being most preferred. When the sheet material is at such a moisture level, prior to processing, it will be more resistant to drying from the heat generated during the processing, thus making the sheet material less prone to tearing and cracking.

The final embossed sheet material may be used in a variety of ways such as, for example, a cigar wrapper or decorated wrapping material. When used, for example, as a cigar wrapper, the finished laminated wrapper 200, shown in the photograph of FIG. 8, is wrapped on the outside of a cigar as shown in FIGS. 9 and 10 around a binder layer 400 and a center bunch portion 500. The advantages of such a decorated, manufactured cigar wrapper reside principally in cost reduction and the ability to incorporate various flavoring and aromatic aids in the wrapper. Also, laminated sheet material offers the ability to use different sheets having a symbiotic relationship with respect to one another. Corresponding patent application, Ser. No. 727,054, filed on Sept. 27, 1976 now U.S. Pat. No. 4,109,665 in the names of the same inventors and entitled DECORATED CIGAR WRAPPERS, discusses in detail such a decorated cigar wrapper. The subject matter of this concurrently filed application is incorporated herein by this reference.

The following example serves to illustrate the present invention and should not be construed as limiting its scope.

EXAMPLE

In order to more clearly illustrate the properties of a decorated cigar wrapper which was decorated according to the method and using the apparatus of the present invention, a sheet of conventional manufactured cigar wrapper was decorated and then laminated to a second sheet of conventional manufactured cigar wrapper. Each of the two sheets had a thickness of about 0.0015 inches, a tobacco content in excess of 65% and the following physical properties:

| LAMINATING SHEET (Prior to processing) | |
|---|---|
| dry long strength: | 540 g/in |
| dry transverse strength: | 135 g/in |
| Mullen strength: | 1.45 lb/in$^2$ |
| smoothness - top: | 25 seconds/25cc/in$^2$ |
| smoothness - bottom: | 32 seconds/25cc/in$^2$ |
| sheet weight: | 155 g/ft.$^2$ |
| sheet moisture: | 24.84% |

| DECORATING SHEET (Prior to processing) | |
|---|---|
| dry long strength: | 650 g/in |
| dry transverse strength: | 410 g/in |
| Mullen strength: | 1.95 lb/in$^2$ |
| smoothness - top: | 60 seconds/25cc/in$^2$ |
| smoothness - bottom: | 100 seconds/25cc/in$^2$ |
| sheet weight: | 1.40 g/ft$^2$ |
| sheet moisture: | 25.30% |

The decorating sheet was coated on one surface with the following coating:

| Ingredients | Percent By Weight |
|---|---|
| cellulose-acetate-propionate | 10% |
| ethyl alcohol | 63% |
| ethyl acetate | 27% |

The laminating sheet had originally been coated on its underside with the following coating:

| Ingredients | Percent By Weight |
|---|---|
| cellulose-acetate-propionate | 5.0% |
| acetylated monoglyceride | 5.0% |
| ethyl alcohol | 63.0% |
| ethyl acetate | 27.0% |

Each sheet was coated at a level of about 80 mg/ft$^2$ measured on a dry weight basis.

The laminating and decorating sheets were simultaneously processed through the apparatus of FIG. 2, the decorating sheet first having a raised, vein-like pattern embossed through its thickness at a pressure of 60 psi and at a temperature of 262° F.

Base color was applied at a base color station at a temperature of 80° F. with an alcohol soluble ink and a shade color pattern was applied at a temperature of 84° F. at a shade color station, also using an alcohol soluble ink of a contrasting color to the base color ink. The decorating sheet was then laminated to the laminating sheet at a temperature of 281° F. and at a pressure of 60 psi.

The resultant decorated, laminated cigar wrapper, was humidified and rewound. Subsequent testing indicated that the wrapper had the following physical properties:

dry long strength; 700 g/in
dry transverse strength; 330 g/in
Mullen Strength; 1.65 lb/in$^2$
smoothness top; 80 seconds/25cc/in$^2$
sheet weight; 3.38 g/ft$^2$
sheet moisture; 30.4%

The resultant decorated cigar wrapper, although being a manufactured cigar wrapper, had the appearance of a natural tobacco leaf and the physical properties of a commercially acceptable cigar wrapper.

Although the foregoing example illustrates the formation of a decorated, laminated cigar wrapper, using the apparatus and methods of the present inventions, it will be appreciated that the presently disclosed apparatus and method may be used to manufacture sheet material for use in numerous other applications. Accordingly, the present invention should be limited only by the true scope of the appended claims.

Wherefore we claim:

1. Apparatus for decorating a sheet of manufactured cigar wrapper material, said apparatus comprising:

a rotatably mounted central sheet guide cylinder;

a decorating roller positioned about said guide cylinder, said decorating roller having a decorative veinlike pattern on its outer surface and adapted to rotate in a direction opposite from the direction of rotation of said cylinder in order to draw said sheet material through the nip between said cylinder and said decorating roller to emboss a raised decorative vein-like pattern on one surface of said sheet material and a complimentary depressed vein-like pattern on said opposite surface;

coloring means positioned about said cylinder and including at least one color gravure roller having a pattern on the outer surface thereof, at least one color transfer roller in contact with said color gravure roller and said cylinder and means to apply a coloring agent evenly to said color gravure roller, said color transfer roller being mounted to rotate in a direction opposite from the direction of rotation of said color gravure roller and said cylinder whereby said color transfer roller will transfer said coloring agent in the pattern of said color gravure roller to said sheet material as said sheet material is drawn through the nip between the oppositely rotating cylinder and the color transfer roller; and means for reinforcing said vein-like pattern, said means including a hopper mounted adjacent to said cylinder, said hopper adapted to contain a filler material and further adapted to continuously and controllably deposit said filler material through distribution means on said hopper along the opposite surface of said sheet material as it passes around said cylinder, said reinforcing means further including means to compress the filler material within the depressed vein-like pattern and remove excess filler material from said opposite surface.

2. The apparatus of claim 1 further including shading means positioned adjacent said guide means and including at least one shade gravure roller having a shade pattern on the outer surface thereof, at least one shade transfer roller in contact with said shade gravure roller and said guide means and means to apply a shading agent evenly to said shade gravure roller, said shade transfer roller being mounted to rotate in a direction opposite from the direction of rotation of said shade gravure roller and said guide means, whereby said shade transfer roller will transfer said shading agent in the pattern of the shade gravure roller to said sheet material as said sheet material is drawn through the nip between the oppositely rotating guide means and shade transfer roller.

3. The apparatus of claim 1 wherein said means to evenly apply a coloring agent comprises an open pan for receiving and retaining said coloring agent and a doctor blade, said open pan being positioned relative to said color gravure roller such that the coloring agent in said pan is applied to the outer surface of said color gravure roller during rotation thereof and said doctor blade being mounted relative to and spaced sufficiently from said color gravure roller to remove excess coloring agent from said color gravure roller.

4. The apparatus of claim 1 wherein said means to evenly apply a shading agent comprises an open pan for receiving and retaining said shading agent and a doctor blade, said open pan being positioned relative to said shading gravure roller such that the shading agent in said pan is applied to the outer surface of said shade gravure roller during rotation thereof and said doctor blade being mounted relative to and spaced sufficiently from said shade gravure roller to remove excess shading agent from shade gravure roller.

5. The apparatus of claim 1 further including coating means for applying a hydrophobic coating to said decorated, colored and shaded sheet material, said coating means including a stripping roller adjacent said guide means, at least one coating gravure roller, at least one coating transfer roller in contact with said coating gravure roller and said stripping roller, and means to apply a coating agent evenly to said coating gravure roller, said coating transfer roller being mounted to rotate in a direction opposite from the direction of rotation of said coating gravure roller and said stripping roller, said coating transfer roller being mounted to transfer said coating agent from said coating gravure roller to said sheet material as said sheet material is drawn through the nip between the oppositely rotating stripping roller and the coating transfer roller.

6. The apparatus of claim 1 further including staining means for applying a stain to said decorated, sheet material, said staining means including a second rotatably mounted sheet guide means, at least one staining gravure roller, at least one staining transfer roller in contact with said gravure roller and said second sheet guide means and means to apply a stain evenly to said staining gravure roller, said staining transfer roller being adapted to rotate in a direction opposite from the direction of rotation of said staining gravure roller and said second sheet guide means, whereby said staining transfer roller will transfer said stain from said staining gravure roller to said sheet material as said sheet material is drawn through the nip between the oppositely rotating second guide means and the staining transfer roller.

7. The apparatus of claim 6 further including means to humdify the decorated and colored cigar wrapper.

8. The apparatus of claim 1 wherein said hopper includes a rotatably mounted blade feeder for controlling the amount of filler material continuously deposited along said opposite surface.

9. The apparatus of claim 1 wherein said hopper includes a rotatably mounted doffer for preventing the agglomeration of filler material within said hopper.

10. The apparatus of claim 1 wherein said means to compress and remove filler material comprises a doctor blade adjustably mounted on said hopper and positioned adjacent to said cylinder.

11. Apparatus for decorating at least one layer of manufactured cigar wrapper sheet material and laminating said one layer to a second undecorated layer of sheet material, said apparatus comprising:

a rotatably mounted central guide cylinder;

a decorating roller positioned about said central guide cylinder, said decorating roller having a decorative pattern on its outer surface and being mounted to rotate in a direction opposite from the direction of rotation of said cylinder in order to draw said at least one layer of sheet material through the nip between said cylinder and said decorating roller in order to emboss a decorative vein-like pattern on said at least one layer forming a raised pattern on one surface of said one layer and a complimentary depressed pattern on said opposite surface;

means for reinforcing said vein-like pattern, said means including a hopper mounted adjacent to said cylinder, said hopper adapted to contain a filler material and further adapted to continuously and controllably deposit said filled material through distribution means on said hopper along the opposite surface of said one layer as it passes around said cylinder, said reinforcing means further including means to compress the filler material within said depressed pattern and to remove excess filler material from said opposite surface; and an internally heated laminating roller positioned about said cylinder, said laminating roller adapted to rotate in a direction opposite from the direction of rotation of said cylinder in order to draw the one decorated layer of sheet material and the second undecorated layer of sheet material through the nip between the cylinder and said laminating roller.

12. The apparatus of claim 11 further including coloring means positioned adjacent to said guide means and including at least one color gravure roller having a pattern on the outer surface thereof, at least one color transfer roller in contact with said color gravure roller and said guide means and means to apply a coloring agent evenly to said color gravure roller, said color transfer roller being mounted to rotate in a direction opposite from the direction of rotation of said guide means and said color gravure roller, whereby said color transfer roller will transfer said coloring agent in the pattern of said color gravure roller to said one layer of sheet material as said one layer is drawn through the nip between the oppositely rotating guide means and the color transfer roller.

13. The apparatus of claim 11 further including shading means positioned adjacent to said guide means and including at least one shade gravure roller having a shade pattern on the outer surface thereof, at least one shade transfer roller in contact with said shade gravure roller and said guide means and means to apply a shading agent evenly to said shade gravure roller, said shade transfer roller mounted to rotate in a direction opposite from the direction of rotation of said shade gravure roller and said guide means whereby said shade transfer roller will transfer said shading agent in the pattern of said shade gravure roller to said one layer of sheet material as said one layer is drawn through the nip between the oppositely rotating guide means and the shade transfer roller.

14. The apparatus of claim 11 further including coating means positioned adjacent said laminating roller, said coating means including at least one coating gravure roller, at least one coating transfer roller in contact with said guide means and said coating gravure roller and means to apply a hydrophobic coating agent evenly to said coating gravure roller, said coating transfer roller being mounted to rotate in a direction opposite from the direction of rotation of said laminating roller and said coating gravure roller, whereby said coating transfer roller will transfer said coating agent from said coating gravure roller to said laminated sheet material as said sheet material is drawn through the nip between the oppositely rotating laminating roller and the coating transfer roller.

15. The apparatus of claim 11 further including staining means for applying a stain to said decorated, and laminated sheet material, said staining means including a second rotatable sheet guide means, at least one staining gravure roller, at least one staining transfer roller in contact with said second guide means and said staining gravure roller and means to apply a stain evenly to said staining gravure roller, said staining transfer roller being mounted to rotate in a direction opposite from the direction of rotation of said staining gravure roller and said second guide means, whereby said staining transfer roller will transfer stain from said staining gravure roller to said sheet material as said sheet material is drawn through the nip between the oppositely rotating second guide means and the staining transfer roller.

16. The apparatus of claim 11 further including means to humidify the decorated and laminated cigar wrapper.

17. The apparatus of claim 11 wherein said hopper includes a rotatably mounted blade feeder for controlling the amount of filler material continuously deposited along said opposite surface.

18. The apparatus of claim 11 wherein said hopper includes a rotatably mounted doffer for preventing the agglomeration of filler material within said hopper.

19. The apparatus of claim 11 wherein said means to compress and remove filler material comprises a doctor blade adjustably mounted on said hopper and positioned adjacent to said cylinder.

20. Apparatus for decorating at least one layer of manufactured cigar wrapper sheet material and laminating said at least one layer to at least one undecorated layer of cigar wrapper sheet material, said apparatus comprising:

a rotatably mounted center cylinder having a female depressed vein-like pattern formed on the outer surface thereof;

an embossing roller mounted adjacent to said center cylinder and including internal heating means, said embossing roller having a raised male vein-like pattern formed on the outer surface thereof complimentary to the recessed female vein-like pattern on the face of the center cylinder, said embossing roller mounted to rotate in an opposite direction than said center cylinder in order to draw said at least one layer through the nip between the embossing roller and the center cylinder in order to emboss said vein-like pattern on said layer and form a raised vein-like pattern on one surface of said layer and a complimentary depressed vein-like pattern on said opposite surface;

coloring means mounted adjacent to said center cylinder, said coloring means including at least one color gravure roller having a pattern on the outer surface thereof, at least one internally cooled color transfer roller in contact with said color gravure roller and said center cylinder and means to apply a coloring agent evenly to said color gravure roller, said color transfer roller being mounted to rotate in a direction opposite from the direction of rotation of said center cylinder and said color gravure roller, whereby said color transfer roller will transfer said coloring agent in the pattern of said color gravure roller to said one layer as said one layer is drawn through the nip between the oppositely rotating center cylinder and the color transfer roller; and shading means positioned adjacent to said center cylinder and including at least one shade gravure roller having a shade pattern on the outer surface thereof, at least one internally cooled shade transfer roller in contact with said center cylinder and said shade gravure roller and means to apply a shading agent evenly to said shade gravure roller, said shade transfer roller being mounted to rotate in a direction opposite from the direction of rotation of said center cylinder and said shade gravure roller whereby said shade transfer roller will transfer said shading agent in the pattern of said shade gravure roller to said one layer as said one layer is drawn through the nip between the oppositely rotating center cylinder and shade transfer roller;

means for reinforcing said vein-like pattern, said means including a hopper mounted adjacent to said cylinder said hopper adapted to contain a filler material and further adapted to continuously and controllably deposit said filler material through distribution means on said hopper along the opposite surface of said one layer as it passes around said cylinder, the rate of distribution of said filler material being controlled by a rotatably mounted blade feeder within said hopper, said reinforcing means further including an adjustably mounted and posteriorly positioned doctor blade adapted to compress the filler material within said recessed pattern and to remove excess filler material from said opposite surface; and an internally heated, laminating roller positioned adjacent to said center cylinder, said laminating roller adapted to rotate in a direction opposite from the direction of rotation of said center cylinder in order to draw the layers of sheet material through the nip between said center cylinder and said laminating roller in order to effect lamination of said layers.

21. The apparatus of claim 20 further including feeder means for feeding said layers toward said center cylinder and for drawing at least one layer around said center cylinder for decoration, coloring and shading.

22. The apparatus of claim 21 further including drawing means for drawing said decorated, colored, shaded and laminated sheet material from said center cylinder.

23. The apparatus of claim 22 further including a humidifier located between said center cylinder and said drawing means.

24. The apparatus of claim 20 wherein said hopper includes a rotatably mounted doffer for preventing the agglomeration of filler material within said hopper.

25. The apparatus of claim 20 wherein said means to compress and remove filler material comprises a doctor blade adjustably mounted on said hopper and positioned adjacent to said cylinder.

* * * * *